United States Patent [19]

Spital

[11] Patent Number: 4,861,054

[45] Date of Patent: Aug. 29, 1989

[54] PEDAL-POWERED SKATEBOARD

[76] Inventor: Wade Spital, 2319 Dutton Ave., Santa Rosa, Calif. 95407-6979

[21] Appl. No.: 78,657

[22] Filed: Jul. 28, 1987

[51] Int. Cl.[4] ..... B62M 1/04

[52] U.S. Cl. ..... 280/221; 280/11.115; 280/11.28; 280/87.042

[58] Field of Search ..... 280/221, 11.115, 11.28, 280/11.27, 87.04 A, 87.04 R, 255, 251

[56] References Cited

U.S. PATENT DOCUMENTS

| | | | |
|---|---|---|---|
| 1,259,592 | 3/1918 | Benson | 208/113 |
| 2,148,919 | 2/1939 | Winding | 280/221 |
| 2,185,698 | 1/1940 | Wright | 280/251 |
| 3,285,618 | 11/1966 | Welch | 280/11.115 |
| 3,399,906 | 9/1968 | Portnoff | 280/221 |
| 3,415,540 | 12/1968 | Portnoff | 280/221 |
| 3,774,924 | 11/1973 | Machatsch | 280/11.28 |
| 4,094,524 | 6/1978 | Carroll | 280/11.2 |
| 4,124,222 | 11/1978 | Moe et al. | 280/255 X |
| 4,159,830 | 7/1979 | Solimine | 280/87.04 A X |
| 4,184,693 | 1/1980 | Whitmarsh | 280/11.28 |
| 4,186,934 | 2/1980 | Collings | 280/221 |
| 4,398,735 | 8/1983 | Evans et al. | 280/11.28 |
| 4,411,442 | 10/1983 | Rills | 280/221 |
| 4,595,209 | 6/1986 | Tsai | 280/11.115 |

FOREIGN PATENT DOCUMENTS

| | | | |
|---|---|---|---|
| 2726961 | 1/1979 | Fed. Rep. of Germany | 280/11.115 |
| 1189306 | 10/1959 | France | 280/11.115 |
| 2447210 | 9/1980 | France | 280/87.04 A |

*Primary Examiner*—David M. Mitchell

[57] ABSTRACT

Improved propulsion, suspension, and steering means for a skateboard-like vehicle which can be propelled and steered entirely by the feet of a rider without those feet touching the ground. An actuating means is also provided which allows the operation of brakes and/or other appropriate mechanisms without the repositioning of the rider's feet on the vehicle's foot supporting surface. The vehicle incoporates front and rear, independently-actuable pedals (53, 53R) which are actually discontinuous sections of the foot supporting platform or deck. These, combined with their support means (54, 55-front; 54R, 55R-rear), compose opposing front and rear level members which are pivotally mounted along crosswise axes. The pivotal axis of the front pedal is positioned substantially to the rear of the pivotal axis of the rear pedal so that the pedals can achieve a greater range of motion with a minimum of angular deviation. Each pedal support means retains a roller (58, 58R) which moves up and down with the support means. Using the front drive train as an example, a drive belt (52) is fixed in its middle to the frame (50) of the vehicle and is guided by two other rollers before winding around and terminating at a drive sleeve (76) to which it is fixed at its front end. When the pedal (53) is depressed, the roller (58) descends into the drive belt (52) causing it to unwind from the drive sleeve (76), imparting in it, a rotational motion. The drive sleeve retains one way clutches (80 and 81) which engage a wheel axle (82) causing a wheel (92) to rotate and propel the vehicle. A return spring (78) biases the drive sleeve to rotate in other direction when the rider lifts their foot off the pedal. At that time, the vehicle coasts, as the drive sleeve (76) disengages from the drive axle (82), winding up the drive belt (52) and pushing the pedal (53) back up to its original position. Other embodiments include a vehicle with a crank-clutch-gear drive and a vehicle with an alternate arrangement and style of pedal brackets.

14 Claims, 11 Drawing Sheets

PEDAL-POWERED SKATEBOARD

FIELD OF INVENTION

This invention relates to human-powered vehicles, specifically to a human-powered skateboard-like vehicle which can be propelled and steered entirely by the feet of a rider without those feet touching the ground.

PRIOR ART

Skateboards

Heretofore, skateboards have been powered by the rider applying a propelling leverage directly against the ground with one of their feet. One foot steers the vehicle and supports the rider while the other foot engages the ground and pushes the rider and vehicle forward. Though the skateboard has recently enjoyed an increase in popularity, its use has been limited partially because this basic propulsion system is inefficient and will not allow the vehicle to attain very high speeds. There are several reasons for this.

First, a good proportion of the rider's weight must be shifted out and over the side of the foot-supporting platform or deck in order to develop sufficient friction between his or her power foot and the ground. The more power the rider wants to push with, the more weight he or she must shift in order to achieve this friction. The direction of this weight shift is for the most part at a right angle to the direction of travel of the vehicle. Since it does not directly aid in the vehicle's forward propulsion, this motion wastes some of the rider's energy. Second, good use is not made of the leg's potential muscle power. The propelling force against the ground is applied at the end of, and at a right angle to, the leg, which acts as a long lever. This is mechanically inefficient. It whould be like trying to lift a heavy weight with one's arm extended instead of in close to the body. The skateboard power motion tends to "skew." the rider's body as the rider leans out and over the side of the board to push in a backward direction against the round with their foot.

Finally, when a rider takes one foot off the board to push them self forward, the ankle of the "on-board" foot must not only support all of the rider's body weight but must also steer the board. The rider must keep the deck level when going straight, or tilt it when desiring to turn. All of this must go on while his or her center of gravity is moving out and over the side of the board and back again. Not can balance be somewhat difficult, but the angle of the on board foot tends to tire easily.

Other Human-Powered Wheeled Vehicles

There are many other human-powered wheeled vehicles including bicycles, scooters, carts, and roller skates. Many of these are intended primarily as toys and are not efficient, comfortable, or convenient enough to offer a viable means of transportation. Still others are also viewed as recreational vehicles, and like skateboards, are sometimes used by school age children as a primary means of getting around. The bicycle, however, is widely used as a viable form of transportation by people of many ages. Its pedaling means, large wheels, and simple chain drive afford it a great deal of overall efficiency and utility. A brief comparison of skateboards and bicycles establishes a perspective which is relevant to the field of my invention.

The skateboard and bicycle both allow the rider to bank during turns, but on a skateboard the integrity of the banking is interrupted during the propelling motion since the rider's weight must move out to the side and back. The pedeling motion of the bicycle is much more efficient because the rider's weight is directly over and in line with the direction of force applied to the pedals. The rider's weight also stays in line with the direction of travel. A bicycle's gearing can furthermore be designed to optimize human muscle power with regard to speed. On a skateboard one is limited how fast one can engage the ground and "push off".

A skateboard however can be steered and propelled entirely by the feet. It can be mounted and dismounted easily and its operation leaves the hands free to do other things such as carry something. To safely carry something on a bicycle one must put it in a basket or fasten it to oneself or the bicycle. Furthermore the riding position of a skateboard is standing up so the rider is at about the same level as pedestrians making it easier to communicate with them. On a bicycle it is hard to even balance at walking speed.

Finally, a skateboard is small and light, it can be carried indoors or transported by car or bus easily. A bicycle must usually be locked up out of doors where it is at the mercy of the weather and the risk of vandalism and thievery. Unless your have a foldable bike, putting a bicycle in a passenger car is a cumbersome task, and transporting it frequently requires a special rack.

PRIOR ART PATENTS

Many patents have been issued for occupant-propelled scooters that employ different kinds of pedal or treadle mechanisms for receiving power from the rider's feet. They usually provide some type of rack and pinion mechanism to translate this power into rotational energy to drive one or more of the vehicle's wheels.

U.S. Pat. No. 3,399,906 to Portnoff (Sept. 3, 1968) shows an "Occupant-Propelled Skate Board Vehicle" which the inventor says could also be embodied as a scooter. Although it has a single pedal and is powered by a ratcheting rack and pinion type mechanism, it shows no means for steering the skateboard version.

U.S. Pat. No. 3,415,540 to Portnoff (Dec. 10, 1968) shows an "Occupant-Propelled Play Vehicle" which the inventor claims could be embodied as a scooter or skateboard. It shows a treadle that is operated by both feet of the rider and another ratcheting rack and pinion type power mechanism, but again, provides no means for steering the skateboard version.

U.S. Pat. No. 4,411,442 to Rills (Oct. 25, 1983) shows a "Foot-Powered Wheeled Vehicle". The preferred embodiment employs a hinged pedal at each end of the board. The power is transmitted to the wheels by a pair of ratcheting rack and pinion mechanisms. The vehicle is steered by a modified version of the standard skateboard-roller skate type steering mechanism. This invention however, has several serious practical drawbacks.

Assuming Rills' skateboard is 76 cm (30 inches) long (a standard skateboard length), the outer edge of the pedal would move about 17 cm (6.7 inches) per stroke. Since the rider's foot would probably be 5 to 10 cm (several inches) in from the outer edge of the pedal, the point where the greatest amount of power is transmitted to the pedal would probably only move about 10 to 14 cm (4 to 5.5 inches). On a bicycle most of the power is imparted in the front quarter or third of the crank's revolution, or in about 25 to 35 cm (10 to 14 inches) of pedal motion on an average ten-speed bicycle. For a vehicle of this type to achieve a reasonable degree of efficiency, the power stroke must be great enough to make good use of the leg's muscular potential. Rills' invention would not allow the rider's foot to move an adequate distance during the power stroke and would thus be limited in its capacity to take advantage of the rider's muscle power.

A greater stroke could be attained if the pedals were made longer, but in order to take advantage of this, the rider would have to take an even wider stance to operate them both in alternating succession. The feet would already have to be positioned uncomfortably far apart with Rills' design. Furthermore, lengthening the pedals would require lengthening the vehicle unless the pedal pivots were concurrently moved closer together. The latter would not be possible, though, without moving the wheels closer together also.

To attain the length of power stroke his vehicle does have, Rills depicts the returned pedal (highest position) surface angle to be 37 degrees from horizontal. It would require considerable ankle articulation to keep the foot flat on the pedal at this angle, especially considering that the rider is standing sideways on the vehicle. It would of course be awkward to push with just the edges of the feet. According to tests performed on my prototype, which has a similar pedal structure, this ankle flexing is not only hard on the ankle but it interferes with the ability to steer. I found that while an angle of 25 degrees is fairly comfortable, much over 30 degrees starts becoming quite awkward.

In the area of speed I compared my own first prototype with Rills' vehicle taken at the scale previously mentioned. As a rough method of approximation I used are rider applying 120 power strokes per minute (60 per foot) as a model and calculated a theoretical velocity for each vehicle. At this rate, Rills' vehicle would attain about 5.1 kph (3.2 mph) whereas my first prototype with only 10.2 cm (4 inch) wheels and a 16.2 cm (6.375 inch) height (pedals depressed) would reach about 10.9 kph (6.8 mph, in actuality I have achieved 12.9 kph (8 mph) on level ground).

Furthermore, taken at the scale previously mentioned the wheels of Rills' vehicle would be about 23 cm (9 inches) in diameter and the board's height (pedals depressed) would be about 27 cm (10.6 inches). This would make the vehicle twice as high as a conventional skateboard, putting the rider farther off the ground and increasing the likelihood and potential seriousness of a fall. Although this stability problem could be partially cured by increasing the distance between right and left wheels, the vehicle would probably be substantially larger than a regular skateboard, losing some of the advantages thereof.

In addition, Rills' specification calls for the wheels to be firmly attached to the axle shafts. This would make the vehicle very difficult to turn. A differential, allowing the outer wheel to spin at a greater rate than the inner wheel during a turn, should have been incorporated. Moreover, the front rack would be especially vulnerable and could be easily harmed by a rock or the like. At the scale discussed, the ground clearance of the front rack when the front pedal is depressed would be about 2.2 cm ($\frac{7}{8}$ inch). Finally, the vehicle would probably by noisy, as one of its racks would almost always be ratcheting against its associated pinion.

OBJECTS AND ADVANTAGES

Objects and advantages of the present invention are: to provide a human-powered wheeled vehicle which can be efficiently propelled and steered by the feet of its rider without those feet touching the ground, to provide a drive system with an appropriate drive ratio, one which permits the vehicle to attain reasonable degrees of speed by making optimum use of the rider's muscular potential and by allowing the rider's center of gravity to stay generally over the vehicle and in line with the direction of travel, to provide a versatile pedaling means, one which permits the vehicle to be propelled with either pedal at any time, or to be coasted with both pedals down, in the latter case, thereby granting the increased stability and maneuverability associated with a lowered riding profile and permitting the rider to more easily maintain balance in awkward riding situations.

Further objects and advantages of the invention are: to provide a pedaling mechanism where, during pedaling, the angular deviation of the pedal's foot-supporting surface is minimized, thereby requiring less flexing of the rider's ankles, to provide a drive system where a front wheel is powered by a front pedal and a rear wheel is powered by a rear pedal, thereby making the driven wheels less likely to lose traction because one is always generally under the weight of the foot that is imparting its own power, and to provide a drive system such that it is protected from harm which might otherwise be inflicted by debris or irregularity in the riding surface.

Still further objects and advantages are: to provide a unique steering and suspension system, one which combines the biasing elements of both the steering system, and a shock absorbing suspension system, thereby simplifying the vehicle's design and allowing it to be operated more comfortably on a greater variety of riding surfaces, and to provide a convenient function (braking, drive-ratio-changing, pedal-holding-down, etc.) actuating means which is operable by the feet of the rider while the vehicle is in motion. This would be serviceable without requiring the rider to reposition his or her feet on the vehicle's pedals, thereby minimizing the possibility of the rider's losing balance during its operation, and further making the actuating means more instantly accessible to the feet of the rider. The actuating means may incorporate a safety means to prevent its operation unless both pedals are fully depressed.

Even further objects and advantages of my invention will become apparent through consideration of my drawings and the ensuing description thereof.

DESCRIPTION OF DRAWINGS

First Embodiment

Second Embodiment

Figure 4:
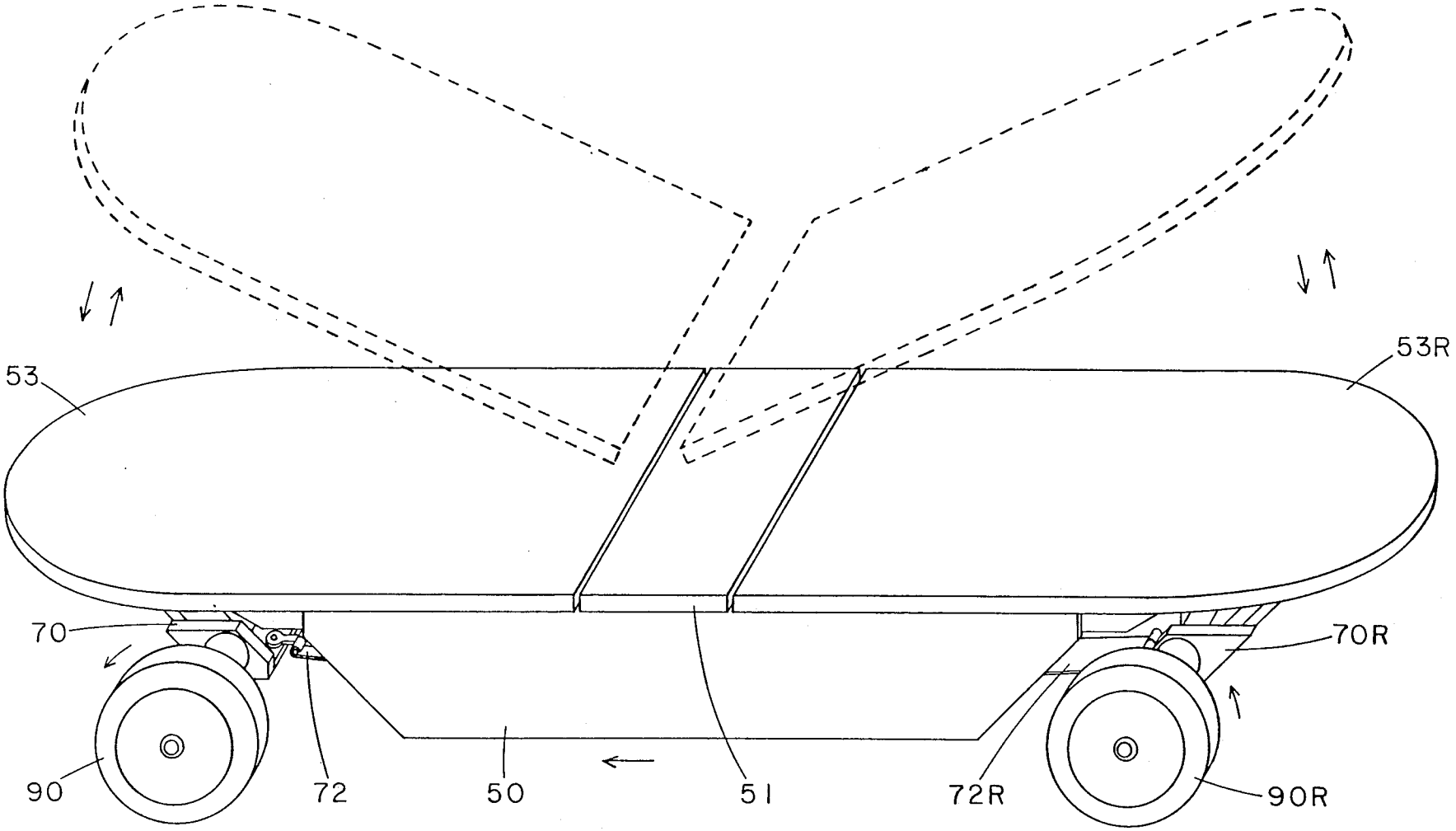

FIG. 4 is a left side perspective view of a second embodiment showing the pedals in both their depressed and returned (broken lines) positions.

Figure 5:
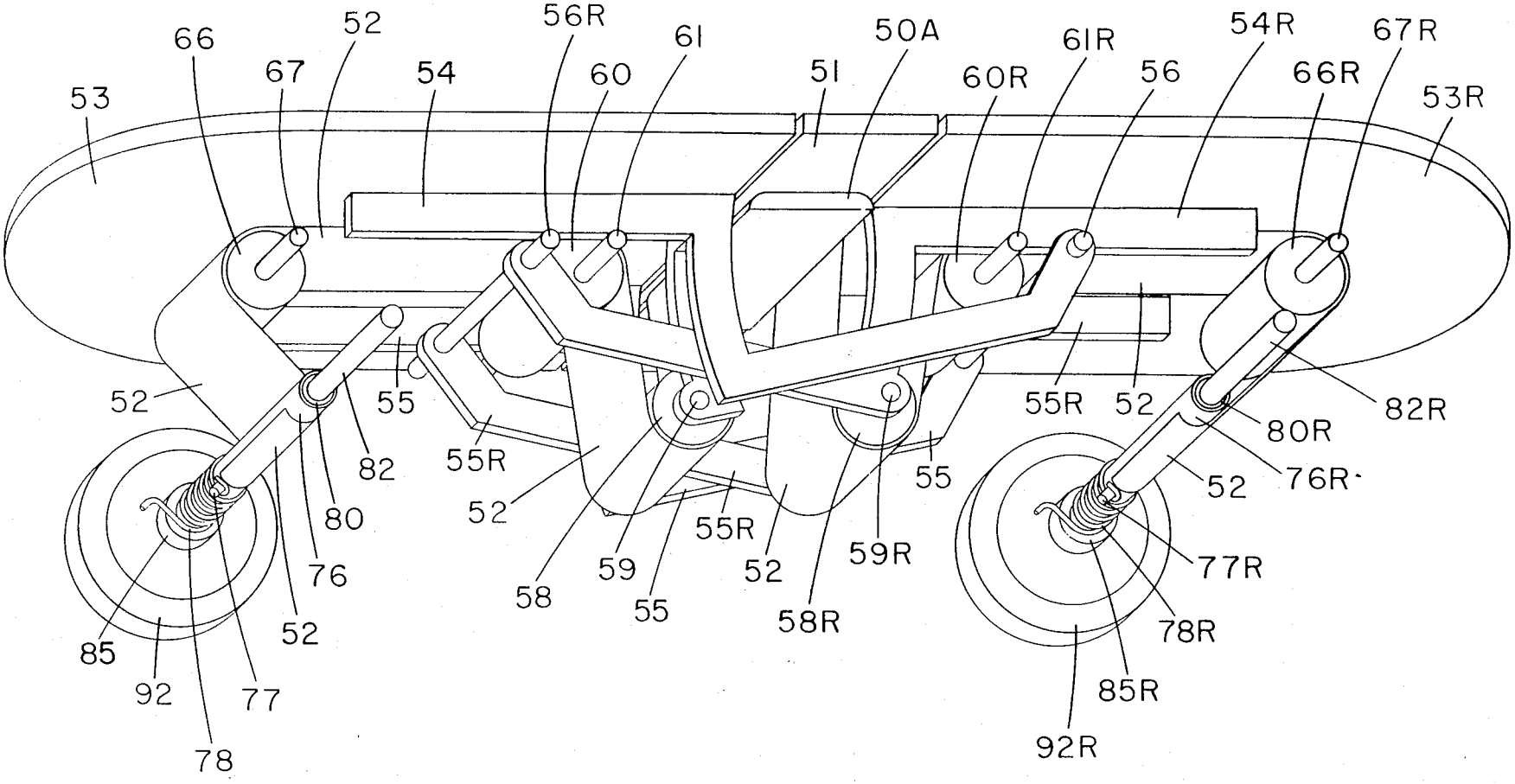

FIG. 5 is a left side perspective view shown from the bottom of a drive train of the second embodiment.

Figure 6:
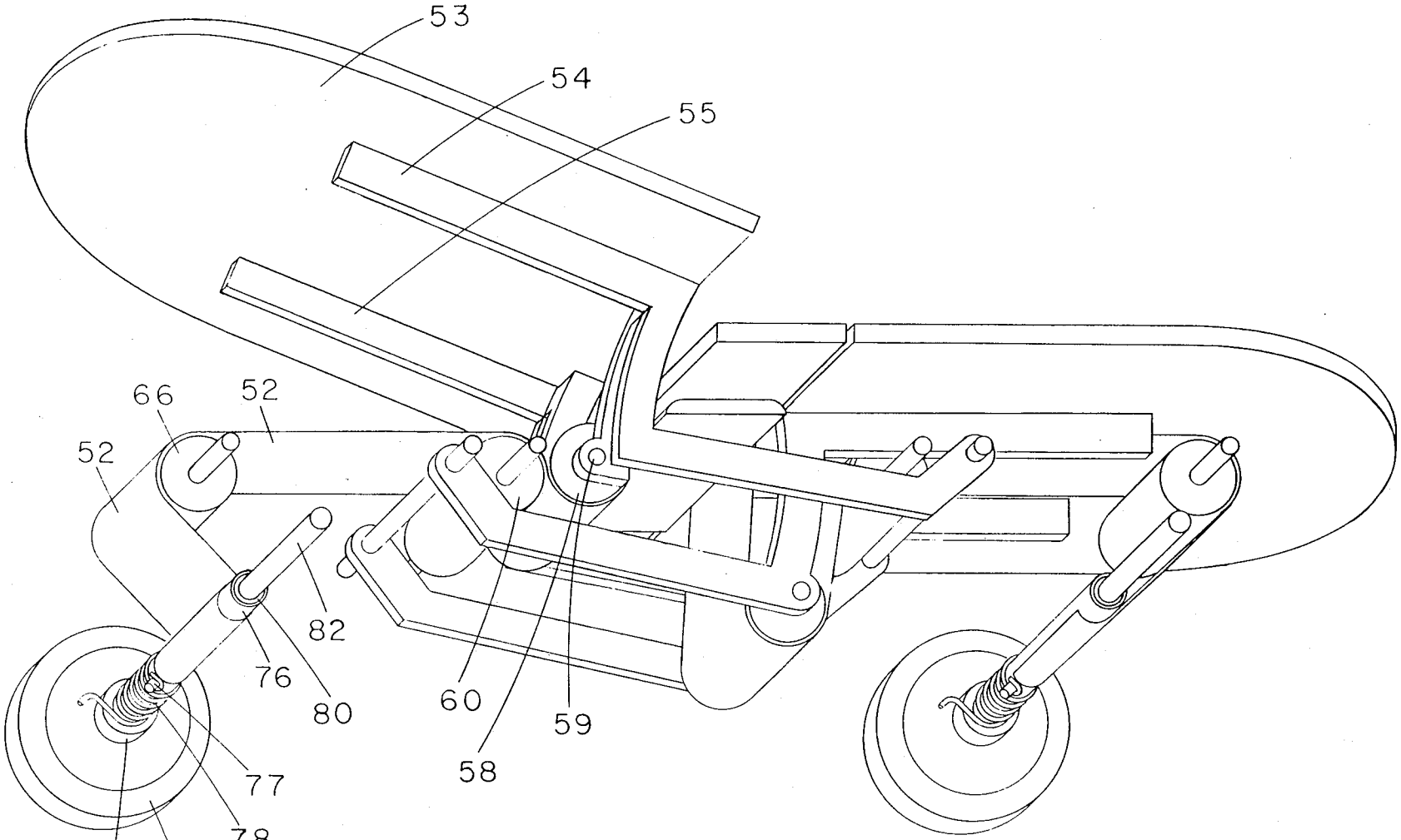

FIG. 6 is a left side perspective view similar to that of FIG. 5, but showing the vehicle with its front pedal in its returned (highest) position.

Figure 7:
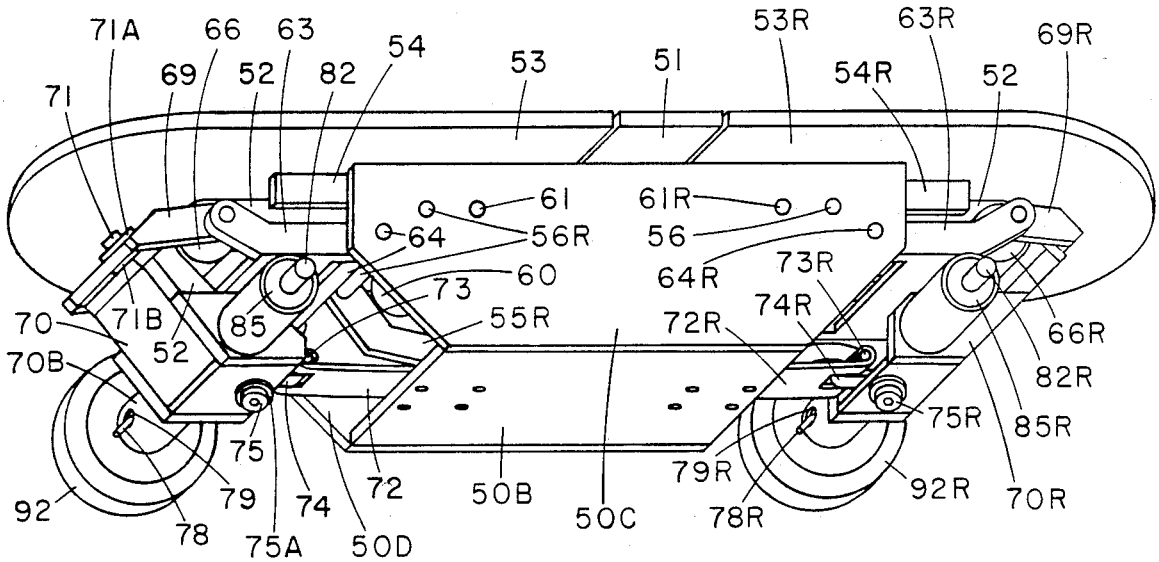

FIG. 7 is a left side perspective view of the second embodiment shown from the bottom with the two left wheels removed.

Figure 8:
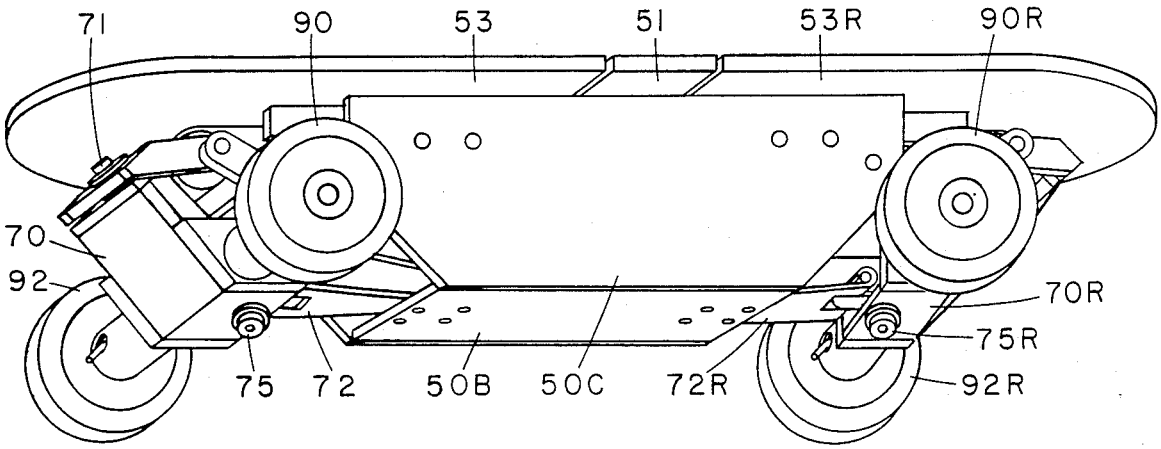

FIG. 8 is a left side perspective view similar to that of FIG. 7 but showing all wheels in place and as if making a left turn.

Figure 9:
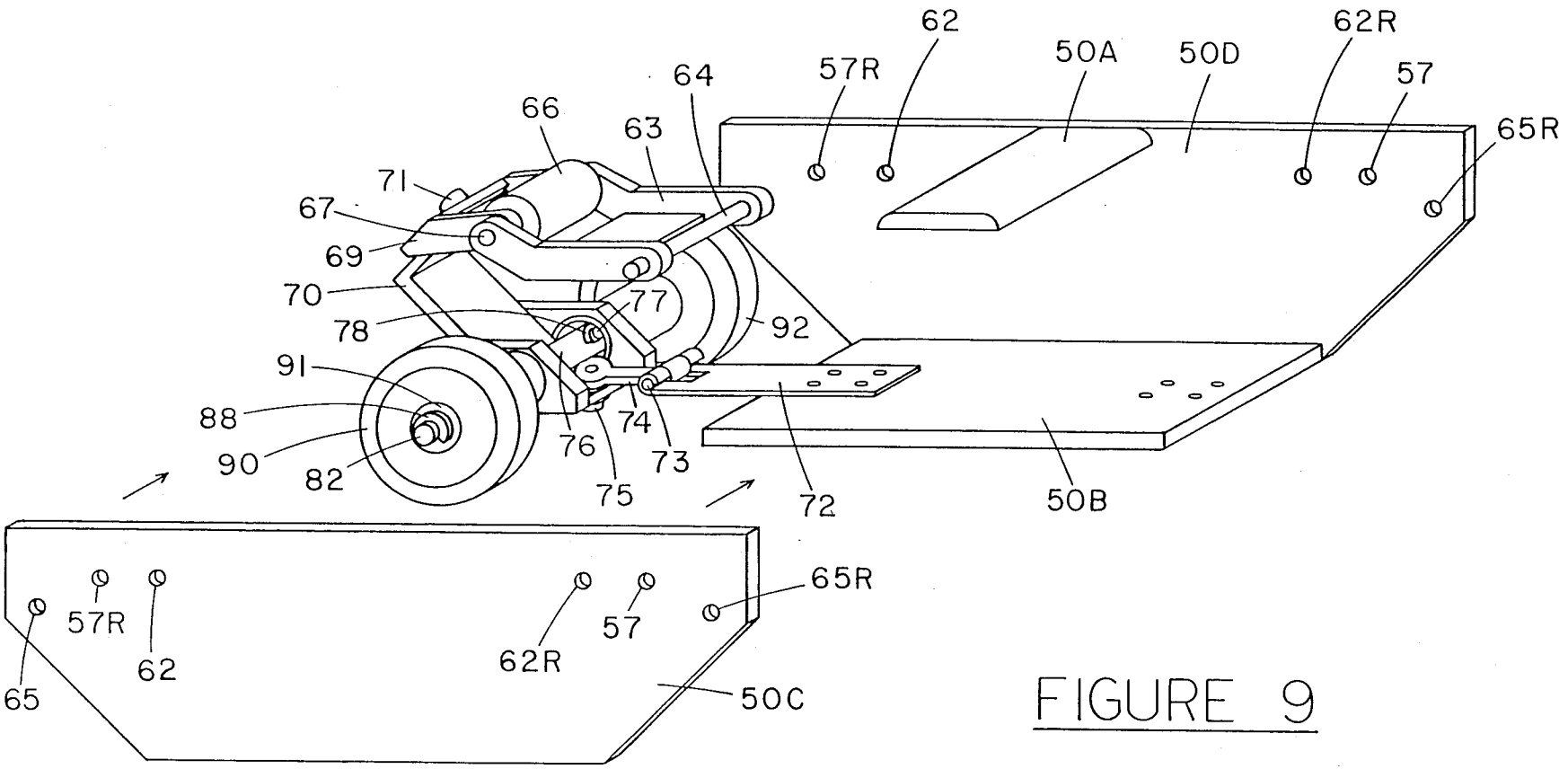

FIG. 9 is a left side perspective view showing the front truck, wheels, suspension gear and frame plates.

Figure 10:
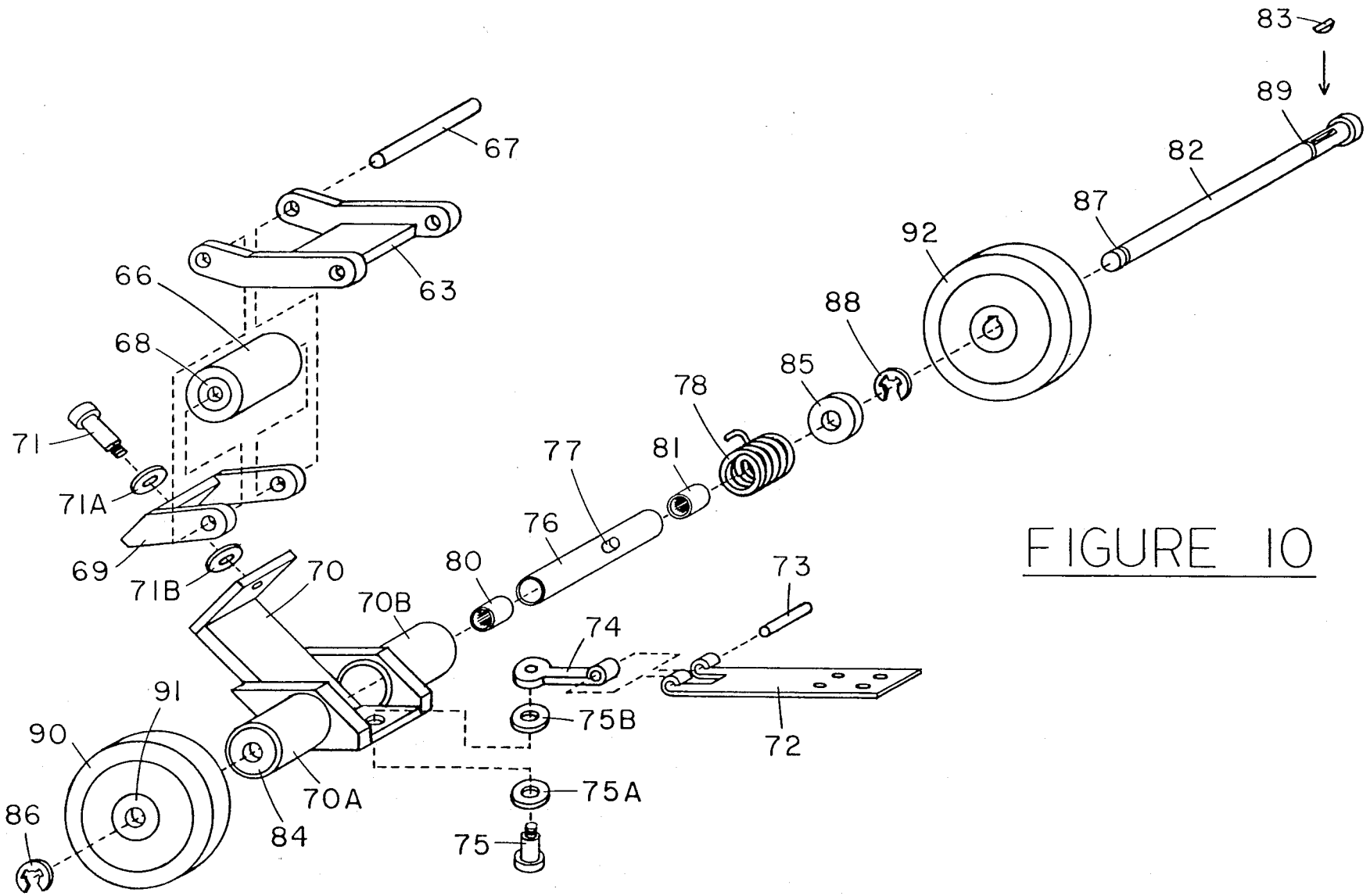

FIG. 10 is an exploded left side perspective view of the front truck, wheels, drive mechanism, and suspension gear.

Third Embodiment

Figure 11:
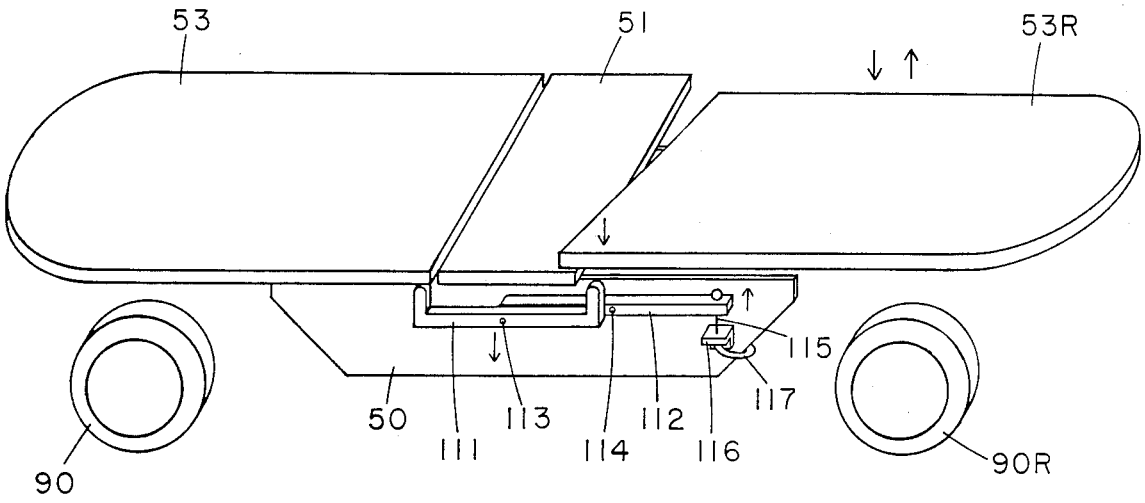

FIG. 11 is a left side perspective view of a cable actuating mechanism of a third embodiment which is presented as a modification to the second embodiment.

Figure 12:
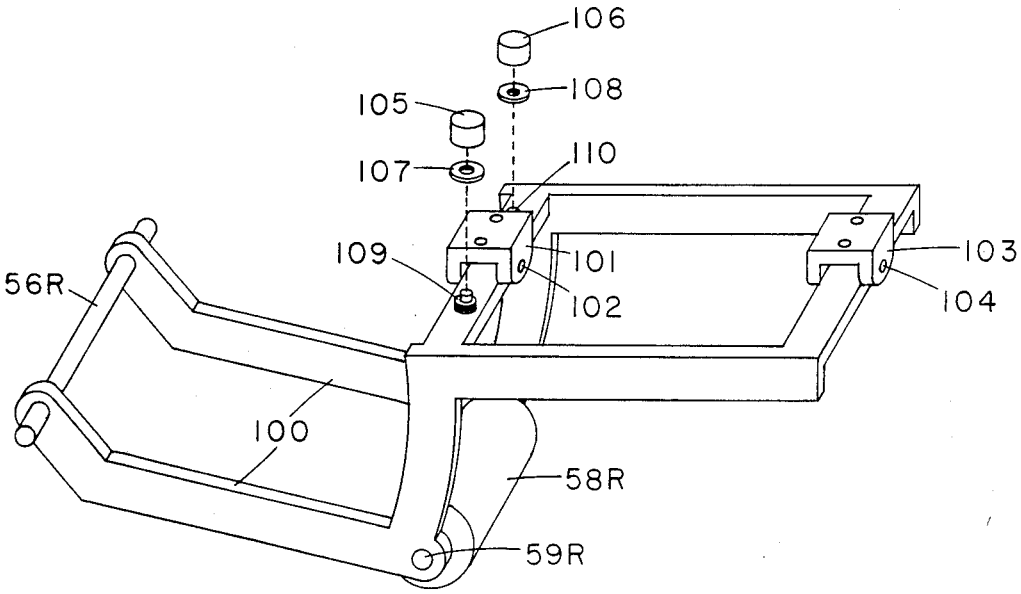

FIG. 12 is a left side perspective view of an alternate pedal bracket and pedal mounting structure of the third embodiment.

Fourth Embodiment

Figure 13:
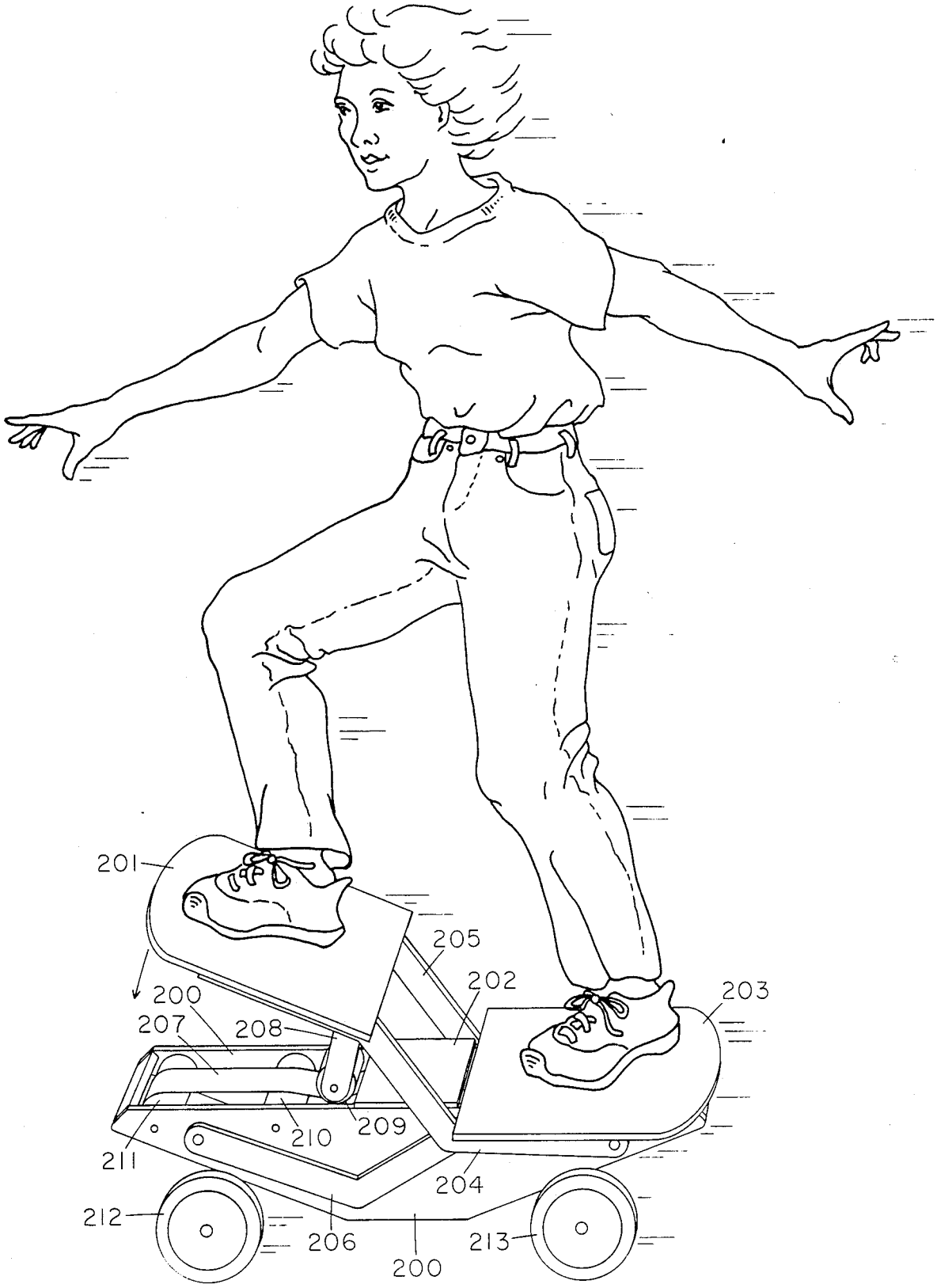

FIG. 13 is a left side perspective view of a fourth embodiment showing a rider about to depress the front pedal.

DRAWING REFERENCE NUMERALS

Figure 1:
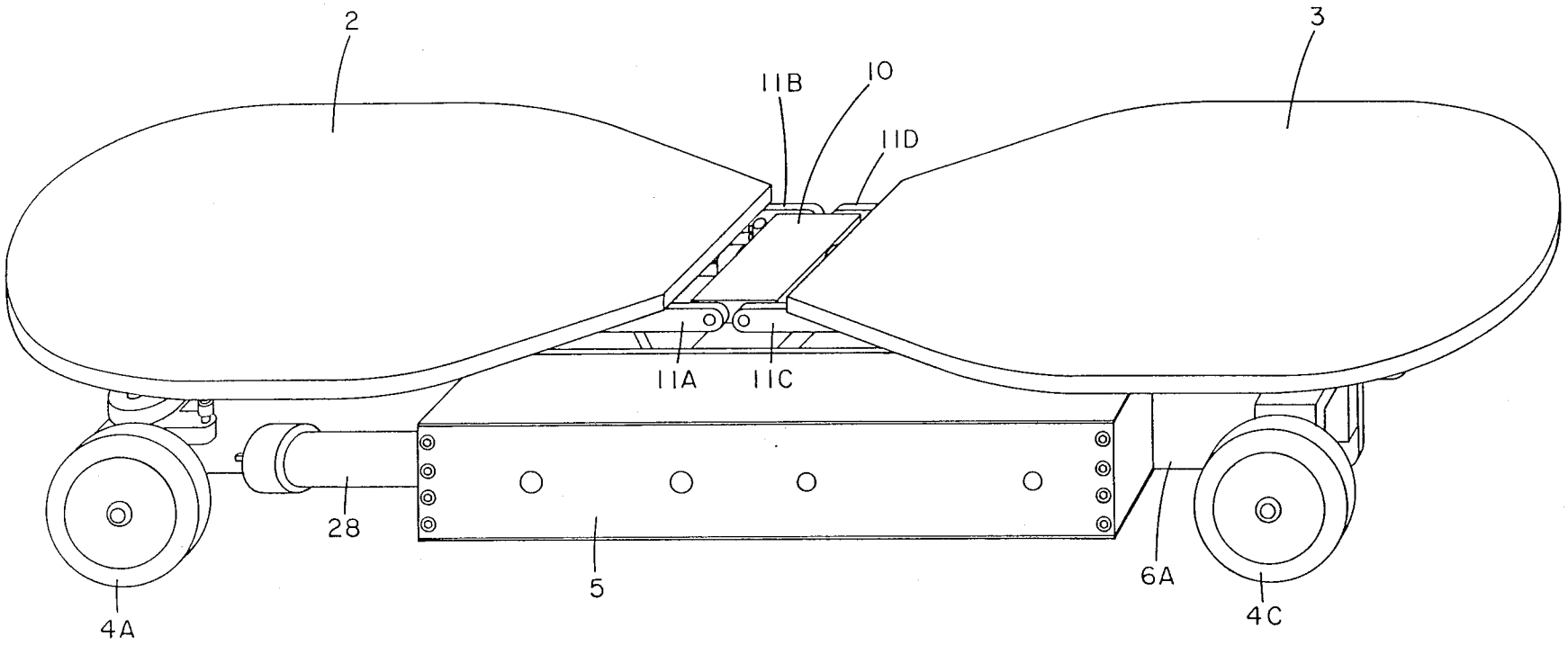
FIG. 1 is a left side perspective view of the first embodiment of a skateboard of my invention with two pedals where both pedals are in their depressed position.
Figure 2:
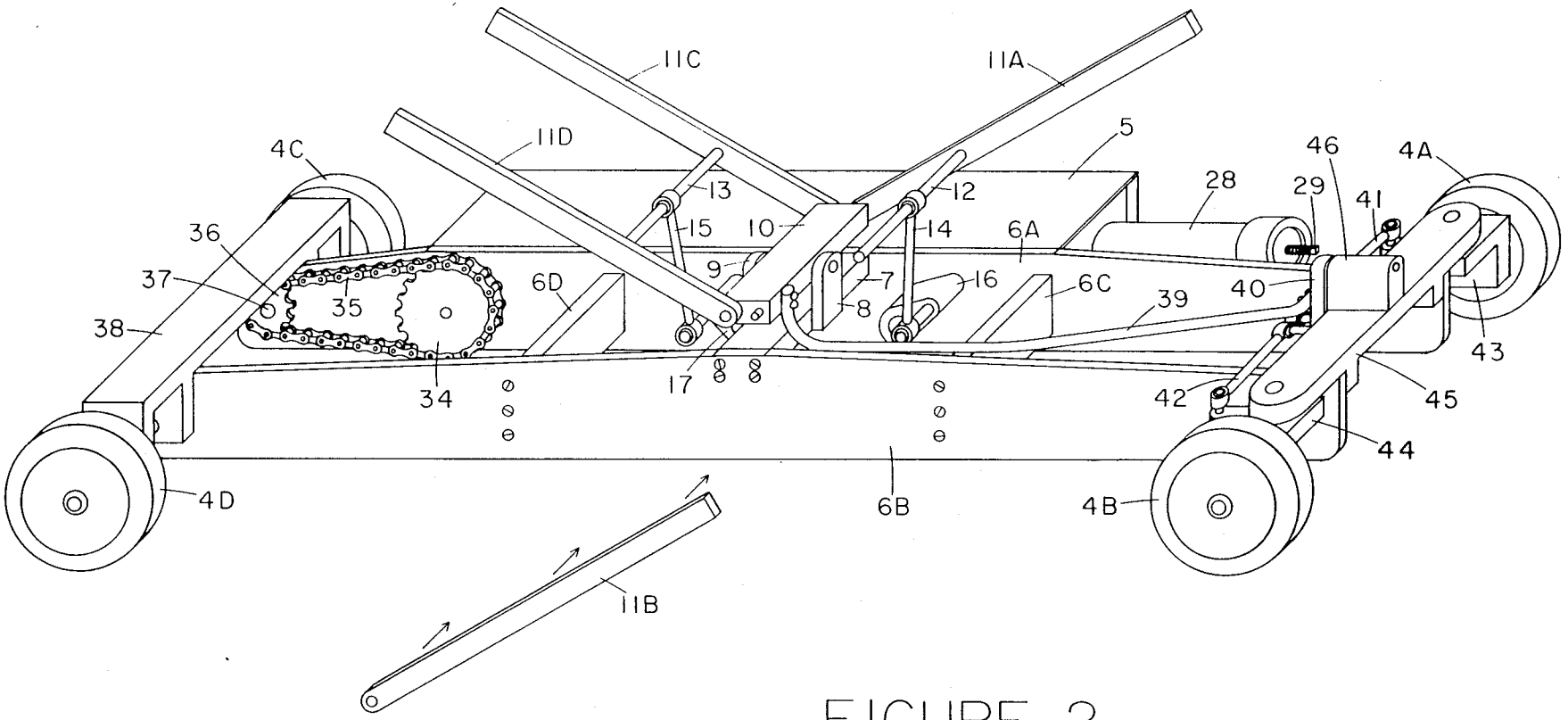
FIG. 2 is a right side perspective view of the first embodiment with the pedals removed.
Figure 3:
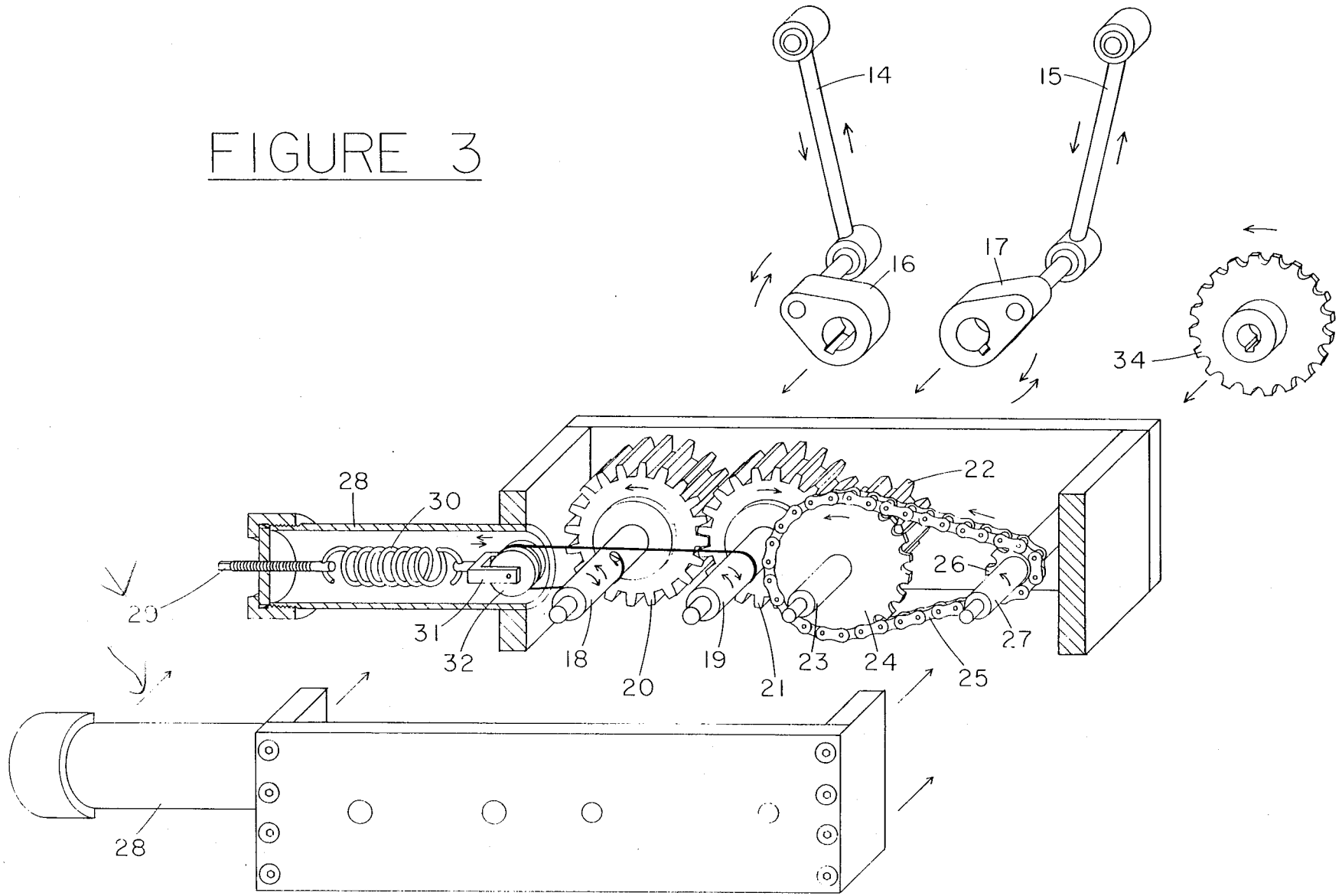
FIG. 3 is a cut-away left side perspective view of the internal transmission mechanism.

First Embodiment—FIGS. 1–3

| | |
|---|---|
| 2 | front pedal |
| 3 | rear pedal |
| 4A | left front wheel |
| 4B | right front wheel |
| 4C | left rear (drive) wheel |
| 4D | right rear wheel |
| 5 | transmission |
| 6A | left frame plate |
| 6B | right frame plate |
| 6C | front frame member |
| 6D | rear frame member |
| 7 | central frame member |
| 8 | front central pivot support member |
| 9 | rear central pivot support member |
| 10 | central pivoting member |
| 11A | left front pedal bracket |
| 11B | right front pedal bracket |
| 11C | left rear pedal bracket |
| 11D | right rear pedal bracket |
| 12 | front cross rod |
| 13 | rear cross rod |
| 14 | front push rod |
| 15 | rear push rod |
| 16 | front crank |
| 17 | rear crank |
| 18 | front crankshaft |
| 19 | rear crankshaft |
| 20 | front main gear |
| 21 | rear main gear |
| 22 | small gear |
| 23 | gear to sprocket shaft |
| 24 | large transmission sprocket |
| 25 | transmission chain |
| 26 | small transmission sprocket |
| 27 | transmission output shaft |
| 28 | return spring tube |
| 29 | return spring tension adjuster |
| 30 | return spring |
| 31 | return spring yoke |
| 32 | return spring pulley |
| 34 | transmission output sprocket |
| 35 | drive chain |
| 36 | drive sprocket |
| 37 | drive axle |
| 38 | rear wheel bracket |
| 39 | steering rod |
| 40 | steering pendulum |
| 41 | left steering connecting rod |
| 42 | right steering connecting rod |
| 43 | left steering truck |
| 44 | right steering truck |
| 45 | front wheel bracket |
| 46 | upright for 40 |

-continued

| | |
|---|---|
| 33 | return spring cable |

DRAWING REFERENCE NUMERALS

Second Embodiment—FIGS. 4–10

Not listed here, are reference numerals with an "R" (for "rear") suffix. These are used in the second embodiment to denote rear counterparts to similar or identical front components.

| | |
|---|---|
| **Central Components** | |
| 50 | frame |
| 50A | upper frame plate |
| 50B | lower frame plate |
| 50C | left frame plate |
| 50D | right frame plate |
| 51 | center deck |
| 52 | drive belt |
| **Front Components** | |
| 53 | pedal |
| 54 | left pedal bracket |
| 55 | right pedal bracket |
| 56 | pedal pivot pin |
| 57 | holes for 56 |
| 58 | pedal roller |
| 59 | pedal roller pin |
| 60 | mid roller |
| 61 | mid roller pin |
| 62 | holes for 61 |
| 63 | suspension bracket |
| 64 | suspension bracket pin |
| 65 | hole for 64 |
| 66 | drive roller |
| 67 | drive roller pin |
| 68 | antifriction bearing for 66 |
| 69 | truck bracket |
| 70 | truck |
| 70A | left truck tube |
| 70B | right truck tube |
| 71 | upper kingpin |
| 71A | thrust bearing |
| 71B | thrust bearing |
| 72 | suspension spring |
| 73 | suspension spring pin |
| 74 | tang |
| 75 | lower kingpin |
| 75A | thrust bearing |
| 75B | thrust bearing |
| 76 | drive sleeve |
| 77 | drive sleeve spring catch |
| 78 | return spring |
| 79 | truck tube spring catch |
| 80 | left overrunning clutch |
| 81 | right overrunning clutch |
| 82 | axle |
| 83 | key for 82 and 92 |
| 84 | left axle bearing |
| 85 | right axle bearing |
| 86 | left wheel retaining clip |
| 87 | groove for 86 |
| 88 | right wheel retaining clip |
| 89 | groove for 88 |
| 90 | left wheel |
| 91 | antifriction bearing for 90 |
| 92 | right wheel |

DRAWING REFERENCE NUMERALS

Third Embodiment—FIGS. 11 and 12

Because the third embodiment is presented as a modification to the second embodiment, it is necessary to refer to second embodiment reference numerals for some components.

| | |
|---|---|
| 100 | rear pedal bracket |
| 101 | front pedal yoke |
| 102 | ping for 101 |
| 103 | rear pedal yoke |
| 104 | pin for 103 |
| 105 | left rubber dampener |
| 106 | right rubber dampener |
| 107 | left washer |
| 108 | right washer |
| 109 | left adjustment screw |
| 110 | right adjustment screw |
| 111 | check lever |
| 112 | actuating lever |
| 113 | pin for 111 |
| 114 | pin for 112 |
| 115 | cable |
| 116 | cable housing stop |
| 117 | cable housing |

Fourth Embodiment—FIG. 13

| | |
|---|---|
| 200 | frame |
| 201 | front pedal |
| 202 | center deck |
| 203 | rear pedal |
| 204 | front left pedal bracket |
| 205 | front right pedal bracket |
| 206 | rear left pedal bracket |
| 207 | drive belt |
| 208 | pedal roller bracket |
| 209 | pedal roller |
| 210 | mid roller |
| 211 | drive roller |
| 212 | front left wheel |
| 213 | rear left wheel |

DESCRIPTION OF INVENTION

It is suggested that the reader briefly review FIG. 13 for a graphic overview of the operation of this invention.

In the ensuing description, the term "crosswise" is used to denote a right to left orientation, and the term "lengthwise", to denote a front to rear orientation, both from the standpoint of a rider facing in the direction of travel.

FIRST EMBODIMENT—FIGS. 1-3

Structure of First Embodiment

The first embodiment (FIGS. 1 and 2) has a frame which consists of a pair of frame plates 6A and 6B (FIG. 2) running nearly the length of the vehicle and positioned equidistantly from center. Frame plates 6A and 6B are spaced and rigidified by a central frame member 7, front and rear frame members 6C and 6D, and front and rear wheel brackets 45 and 38.

Four wheels 4A through D are rotatably mounted via antifriction bearings and axles in the rear to rear wheel bracket 38, and in the front to a pair of steering trucks 43 and 44. Steering trucks 43 and 44 are pivotally mounted using antifriction bearings along vertical axes to front wheel bracket 45. Steering pendulum 40 is pivotally mounted along a lengthwise axis to an upright 46 in the middle of front wheel bracket 45. Left and right steering connecting rods 41 and 42 are provided with ball joints on each end connecting steering pendulum 40 to each of the steering trucks 43 and 44.

A pair of central pivot support members 8 and 9 are screwed on the front and back of central frame member 7, thereby forming a yoke which pivotally supports central pivoting member 10. There are a pair of rubber steering dampening bushings (not shown) located between central frame member 7 and central pivoting member 10. One is positioned a short way to the left and the other a short way to the right of the pivotal axis of central pivoting member 10. Each bushing is provided with a tension adjustment screw which threads up through central frame member 7. Each tension adjustment screw abuts into a large washer which pushes its respective rubber dampening bushing up against the bottom of central pivoting member 10. The tension adjustment screws are accessible from the bottom of the vehicle for adjusting the firmness of the steering dampening.

Central pivoting member 10 is connected to steering pendulum 40 by steering rod 39. The pivotal axis of steering pendulum 40 is coaxial with that of central pivoting member 10. Four pedal brackets 11A through D are pivotally mounted by pins and bearing sets to central pivoting member 10 along a pair of closely spaced parallel axes running crosswise. A pair of pedals 2 and 3 (FIG. 1) are rigidly fastened down on to pedal brackets 11A through D.

A front cross rod 12 extends between front pedal brackets 11A and B. A rear cross rod 13 extends between rear pedal brackets 11C and D. The ends of cross rods 12 and 13 each fit snugly into bores on the inside of their respective pedal brackets. Spaced to center on each cross rod are the upper ball joints of push rods 14 and 15 (FIGS. 2 and 3). The lower ball joints of push rods 14 and 15 are connected by crankpins to the distal ends of cranks 16 and 17. Cranks 16 and 17 are fixedly keyed and clamped to crankshafts 18 and 19.

A transmission 5 (FIGS. 1 and 2) has four transmission shafts 18, 19, 23 and 27 (FIG. 3). Each shaft is provided with a bearing journal on each end which rotates inside one of eight sets of roller bearings pressed into the transmission housing. Crankshafts 18 and 19 and output shaft 27 extend through the transmission housing on the right side. In front, the transmission casing is provided with a return spring tube 28 which houses the return spring mechanism. The return spring mechanism consists of a return spring tension adjuster 29, a return spring 30, a return spring yoke 31, a return spring pulley 32, and a return spring cable 33. Both ends of return spring cable 33 are fastened to and wrap in opposite directions around crankshafts 18 and 19, respectively.

Crankshafts 18 and 19 each have a main gear 20 and 21 which they rotatably retain via overrunning clutch-bearing assemblies (not shown). The clutch-bearings assemblies are pressed into their respective main gears 20 and 21 such that they will engage their respective crankshafts when those crankshafts are rotated in opposite directions. Main gears 20 and 21 mesh, and rear main gear 21 also meshes with small gear 22. Small gear 22 is fixedly mounted upon gear to sprocket shaft 23 which also fixedly retains large transmission sprocket 24. Large transmission sprocket 24 is connected by a loop of roller chain, transmission chain 25, to small transmission sprocket 26. The latter is fixedly mounted on transmission output shaft 27 which protrudes from the right side of the transmission housing where if fixedly retains transmission output sprocket 34.

Transmission output sprocket 34 (FIG. 2) is connected by another loop of roller chain, drive chain 35, to drive sprocket 36 which in turn is fixedly mounted upon drive axle 37. Drive axle 37 extends through left frame plate 6A and is rotatably retained via antifriction bearings by rear wheel bracket 38. Left rear wheel 4C is rotatably retained by drive axle 37 via antifriction bearings and an overrunning clutch (not shown).

OPERATION OF FIRST EMBODIMENT

Propulsion

While coasting, a rider is normally standing on the vehicle with one foot on front pedal 2 (FIG. 1) and the other foot on rear pedal 3. Both pedals would then be depressed under the weight of the rider. The rider could at any time lift either foot and its respective pedal 2 or 3 would spring up to the height of the foot or the top of the pedal's stroke, whichever came first. The rider could even jump up and let both pedals rise simultaneously.

To propel the vehicle, when the rider presses down on front pedal 2, for example, the force is transmitted by front pedal brackets 11A and 11B (FIG. 2), and front cross rod 12 to front push rod 14 which moves in a generally downward direction. Front push rod 14 (FIGS. 2 and 3) in turn causes front crank 16 to rotate front crankshaft 18 (FIG. 3) a partial turn in the counterclockwise direction (viewed as drawn). This rotation engages the overrunning clutch of front main gear 20, causing it to also rotate counterclockwise.

At this point, if the rider's front foot is lifted again, return spring 30 will pull on return spring yoke 31 and return spring pulley 32, which will in turn pull on return spring cable 33. Return spring cable 33 will then pull on the bottom of front crankshaft 18 causing it to rotate a partial turn in the clockwise direction, back to its pervious position. Front crankshaft 18 disengages from the overrunning clutch of front main gear 20 in this direction and rotates freely inside of it. As it does so, it causes front pedal 2 to rise through the reverse of motions previously described. Specifically, it rotates front crank 16 clockwise, forcing front push rod 14 to push up on front pedal 2 through front cross rod 12 and front pedal brackets 11A and B.

As can be seen, rear pedal 3 is also returned by return spring 30 in a similar manner. The main difference is that return spring cable 33 unwinds from rear crankshaft 19 from the top thereby causing it to turn counterclockwise during the pedal return motion. Rear crankshaft 19 is allowed to spin freely in this direction as it is disengaged from the overrunning clutch of its main gear 21. Return spring pulley 32 allows return spring cable 33 to pass over it as necessary, effectively distributing the tension provided by return spring 30 equally on the peripheries of crankshafts 18 and 19.

Returning to the depression of front pedal 2, front main gear 20 has been turned a partial turn in the counterclockwise direction. When front main gear 20 turns in the counterclockwise direction it drives rear main gear 21 in a clockwise direction. Rear main gear 21 then rotates on or with rear crankshaft 19 depending on whether or not some power is being imparted through the rear pedal (if not, the overrunning clutch of rear main gear 21 will be disengaged allowing it to idle freely on shaft 19). Rear main gear 21 then drives small gear 22 counterclockwise, initiating the section of the power train designed to increase the drive ratio in order that the vehicle be capable of greater speed.

Specifically, when small gear 22 is driven counterclockwise it turns gear to sprocket shaft 23 which turns large sprocket 24 in the same direction. Through transmission chain 25, large sprocket 24 drives small sprocket 26 which turns output shaft 27 and output sprocket 34. Transmission output sprocket 34 turns drive sprocket 36 (FIG. 2) via drive chain 35. The rotating drive sprocket 36 then turns drive axle 37 which engages the overrunning clutch pressed in left rear wheel 4C. Wheel 4C is turned and propels vehicle forward. The overrunning clutch of left rear wheel 4C allows it to spin freely on axle 37 during coasting. The gearing is such that the rear wheel rotates approximately five times for every pedal stroke allowing the vehicle to achieve a reasonable degree of speed.

As can be seen, the drive train of rear pedal 3 works in basically the same way except that its crank 17 (FIG. 3), crankshaft 19, and main gear 21 turn in an opposite direction from those of front pedal 2 during any given phase of pedaling and small gear 22 is driven directly by rear main gear 21.

In summary, during pedaling, crankshafts 18 and 19 are intermittently rotating back and forth about a third of a turn. They have opposite power directions in which they engage the clutch of their respective main gear 20 or 21. This causes both main gears 20 and 21 to turn (front main gear 20 always turns one way while rear main gear 21 always turns the other way). Rear main gear 21, always transmits its power to small gear 22, but can receive it from front main gear 20 and from rear crankshaft 19, depending upon the pedal or pedals being depressed. During a power stroke from front pedal 2, rear main gear 21 idles on its crankshaft, passing power from front main gear 20 to small gear 22, whereas during a power stroke from rear pedal 3 rear main gear 21 receives power directly from crankshaft 19 and passes it to small gear 22. In the latter case, although front main gear 20 does idle on its crankshaft, it is of no consequence, since it is not a part of the rear pedal's drive train.

Steering

The vehicle is steered when the rider tilts the riding platform (which consists of the two pedals) to the left or right. The tilting action is transmitted through pedal brackets 11*a* through D to central pivoting member 10 which pivots on a pin extending between central pivot support members 8 and 9. Central pivoting member 10 transmits this motion through steering rod 39 to steering pendulum 40 which pivots along the same axis. When steering pendulum 40 swings to the right or left it causes steering connecting rods 41 and 42 to move in the same direction. Steering connecting rods 41 and 42 then cause steering trucks 43 and 44 to pivot, as they are connected at points rearward of the latter's pivotal connection with front wheel bracket 45. Steering trucks 43 and 44 directionally turn front wheels 4A and B, effectively turning vehicle.

The steering action is dampened by the two rubber steering dampening bushings mentioned earlier, they act to prevent central pivoting member 10 from tilting, except by significant force from the rider's feet.

SECOND EMBODIMENT—FIGS. 4–10

The second embodiment is propelled by a partially reciprocating flexible drive element power transmission. The drive element used here is a flat belt 52 which is fastened to frame 50 in its middle and reciprocates on each end, alternately winding upon and unwinding from front and rear wheel-driving members 76 and 76R. The wheel-driving members (drive sleeves) 76 and 76R rotate back and forth, each retaining one way clutches 80 and 81 (FIG. 10, shown in front drive train only) which engage and drive wheel axles 82 and 82R. The two drive systems operate independently, one driving front wheel 92 with power from front pedal 53, and the other driving rear wheel 92R with power from rear pedal 53R.

The embodiment is composed of central, front and rear components. The rear components are symmetrically similar to the front components, and so to simplify matters, my discussion will focus primarily on the central and front components. Instances where front and rear components differ significantly in structure or operation will of course be discussed. As noted, front and rear components use the same reference numerals with the reference numerals for the rear components having an "R" (for "rear") suffix. Please avoid confusion about the location of the pedal pivots. As a result of the overlapping pedal pivot feature of this embodiment, the front pedal pivot is actually positioned rearward of the rear pedal pivot, and so, pin 56 and hole 57 are to the rear of pin 56R and hole 57R.

STRUCTURE OF SECOND EMBODIMENT

A frame 50 (FIG. 4) is made up of four plates 50A, 50B, 50C, and 50D (FIG. 9). These plates may be fastened together by screws, welding, or cast as a single piece. A center deck 51 (FIG. 5) screws down upon top frame plate 50A and in doing so cinches down firmly on drive belt 52 attaching it to frame 50. Drive belt 52 threads to the front around three rollers 58, 60, 66 (FIGS. 5 and 6) and to the rear around three rollers 58R, 60R, 66R and finally winds up around front and rear drive sleeves 76 and 76R respectively. The ends of drive belt 52 are firmly attached to drive sleeves 76 and 76R, preferably by adhesive.

Pedal brackets 54, 55, 54R and 55R are shaped with a lowered section in the middle which permits them to clear other components of vehicle during pedaling. Pedal 53 is fastened to pedal brackets 54 and 55 by screws or another suitable method. Pedal brackets 54 and 55 pivot on pin 56 which extends through them into holes 57 in frame plates 50B and 50D (FIG. 9). Antifriction bearings may be installed in the articulation. Rear pedal brackets 54R and 55R (FIGS. 5 and 6) are positioned generally to the inside of front pedal brackets 54 and 55 although, as can be seen, front pedal brackets 54 and 55 each have an extra member even further inboard extending downward to retain pedal roller 58. Spacers may be used on pins 56 and 56R to correctly hold the relative positioning of front and rear pedal brackets 54, 55, 54R, and 55R. Each pair of pedal brackets may also have one or more structural cross members running between them in non-interfering locations to further strengthen and rigidify each pedal assembly (see FIG. 12 for example).

Each of the six rollers 58, 60, 66, 58R, 60R, and 66R may consist of a section of tubing with antifriction bearings installed in each end. Each roller would then have a pin passing through these antifriction bearings which would extend at each end into appropriate retaining apertures. The size of the rollers may vary and/or spacers may be used to accommodate specific restrictions imposed by each one's particular function and location.

Pedal roller 58 (FIGS. 5 and 6) is rotatably retained by pin 59 between pedal brackets 54 and 55. Pin 59 extends through pedal rollers 58 and into retaining apertures provided in pedal brackets 54 and 55.

Mid roller 60 is rotatably retained by pin 61 between frame plates 50C-and 50D (FIG. 7). Pin 61 extends through mid roller 60 and into retaining holes 62 (FIG. 9) provided in frame plates 50C and 50D.

Suspension bracket 63 (FIGS. 9 and 10) is pivotally retained by pin 64 to frame plates 50C and 50D. Pin 67 pivotally mounts truck bracket 69 to suspension bracket 63 and also rotatably retains drive roller 66. Pin 67 extends out the right and left sides of drive roller 66, through holes provided in truck bracket 69 and into holes provided in suspension bracket 63. A left antifriction bearing 68 is depicted installed in the left side of drive roller 66 (FIG. 10).

Suspension spring 72 (FIGS. 7 through 10) is firmly fastened to bottom frame plate 50B, probably by screws. Tang 74 is pivotally joined along a crosswise axis by pin 73 to suspension spring 72.

Truck 70 is pivotally mounted between truck bracket 69 and tang 74 by upper kingpin 71 and lower kingpin 75 respectively. Articulations are provided with either plain or needle thrust bearing sets depicted as 71A, 71B, 75A, and 75B (FIG. 10). As can be seen the pivotal axis of upper kingpin 71 is at approximately a 45° angle extending downward and inward toward a point below the center of the vehicle. This axis passes through the articulation of lower kingpin 75 and is the pivotal steering axis of truck 70. The rotational axis of lower kingpin 75 is vertical, but more importantly, out of alignment with the steering axis creating a situation where suspension spring 72 acts also to bias the steering means, and must twist (FIG. 8) when truck 70 pivots (more on this later).

Drive sleeve 76 (FIG. 10) has two overrunning clutches 80 and 81, one installed in each end. Overrunning clutches 80 and 81 are oriented to engage axle 82 when drive sleeve 76 is rotated in a counterclockwise direction (viewed as drawn). Rear overrunning clutches are also set to engage their axle 82R when drive sleeve 76R is rotated in a counterclockwise direction, this being a deviation from the general symmetry between front and rear components mentioned earlier. A torsional spring, return spring 78, fits loosely onto drive sleeve 76. A projection on drive sleeve 76, spring catch 77, catches a hooked portion on the left end of return spring 78.

The drive sleeve-return spring assembly is positioned toward the right, inside truck 70 with return spring and right half of drive sleeve 76 inside right truck tube 70B. The left half of drive sleeve 76 then extends beyond the truck's center allowing the width of drive belt 52 to be attached and wind up upon it. A hole, return spring catch 79 (FIGS. 7 and 8) is located toward the outer end of right truck tube 70B and catches a hooked portion on the right end of return spring 78. Return spring 78 is loaded to bias drive sleeve 76 to rotate clockwise relative to truck 70. Two antifriction bearings, axle bearings 84 and 85 (FIG. 10), fit in the outer ends of each truck tube 70A and 70B, capping in the drive sleeve-return spring assembly.

Axle 82 then extends from the right through right wheel 92, which it nonrotatably retains with the help of key 83. Right wheel 92 is held against a head on the right end of axle 82 by retaining clip 88 which fits into groove 89. Axle 82 then extends into right truck tube 70B through right axle bearing 85 and into drive sleeve 76 where it is contiguous with overrunning clutches 80 and 81. Axle 82 continues through truck 70 finally emerging out of left truck tube 70A after passing through left axle bearing 84. Left wheel 90 is then rotatably mounted on the left end of axle 82 by a set of two antifriction bearings, the left of which is depicted as 91. Left wheel 90 and the entire truck assembly is retained on axle 82 by retaining clip 86 which fits into groove 87 on the left end of axle 82.

For reasons explained later, in order for the steering and propulsion systems to cooperate, each steering axis should as much as possible be in line with the section of drive belt 52 which stretches between its respective drive roller and drive sleeve (66 to 76 in the front and 66R to 76R in the rear, FIG. 5).

The exact position of this section changes a small amount, due to the thickness of drive belt 52 as it alternately winds and unwinds from drive sleeves 76 and 76R. In taking this into account, these areas should ideally be designed so that the position of each steering axis is aligned with these sections of drive belt 52, when it is one half way wound around drive sleeves 76 and 76R.

As depicted (FIGS. 5 and 6), drive belt 52 engages both front and rear drive sleeves 76 and 76R in the rear. This deviation from the symmetry previously mentioned necessitates differing geometries in the design of the two trucks 70 and 70R. The bottom of front truck 70 (FIG. 7), is longer than the bottom of rear truck 70R. This allows front drive sleeve 76 to nestle in front of the steering axis of front truck 70. The geometry of the rest of each truck is adjusted accordingly.

Significant variations in symmetry are also found in front and rear pedal brackets 54, 55, 54R, and 55R as mentioned earlier. This is due to the fact that they overlap and must function in the same general area without interfering. I have illustrated rear pedal brackets 54R and 55R as operating primarily to the inside of front pedal brackets 54 and 55 with regards to position. They could also of coarse be arranged with the front pedal brackets toward the inside or in an alternating fashion such as front left, rear left, front right, rear right (from right to left).

OPERATION OF SECOND EMBODIMENT

Propulsion

While coasting, a rider is normally standing on the vehicle with one foot on front pedal 53 (FIGS. 4 through 8) and the other foot on rear pedal 53R. Both pedals would then be depressed under the weight of the rider's feet. The rider could at any time lift either foot and its respective pedal 53 and 53R would spring up to its returned (highest) or partially returned position depending on how high the rider's foot allowed. The rider could even jump up and let both pedals rise simultaneously.

When the rider presses down on front pedal 53 (FIGS. 5 and 6), force is transmitted through front pedal brackets 54, 55 and pin 59 to pedal roller 58 which moves downward. As it descends, pedal roller 58 pushes into drive belt 52 exerting a lengthening force upon it. Drive belt 52 is firmly attached on one end to upper frame plate 50A and so as pedal roller 58 descends, pull is transmitted around mid roller 60 and drive roller 66. Drive belt 52 then imparts a counterclockwise rotational motion (viewed as drawn) in drive sleeve 76 as it unwinds therefrom. Overrunning clutches 80 and 81 then engage axle 82 causing it to also rotate counterclockwise. Axle 82 in turn rotates right wheel 92 in the same direction, pulling vehicle forward. As drive sleeve 76 rotates counterclockwise, return spring 78 is caused to wind up more tightly, further biasing drive sleeve 76 to rotate clockwise.

At this point, if the rider chooses to coast, overrunning clutches 80 and 81 disengage from axle 82, allowing it to rotate freely inside drive sleeve 76. At all times, left wheel 90 is allowed to spin freely on axle 82 so that, during a turn, it may rotate at a different speed than that of right wheel 92.

If the rider's front foot is lifted again. Return spring 78 causes drive sleeve 76 to rotate clockwise which winds up drive belt 52. Drive belt 52 is pulled around drive roller 66 and mid roller 60, and finally exerts a lifting force on pedal roller 58. Pedal roller 58 rises, and along with it, pedal brackets 54 and 55. Pedal brackets 54 and 55 then raise pedal 53 to its returned or partially returned position, depending on how high the rider's foot allows it. This completes one power cycle of the front drive mechanism.

As can be seen the rear drive mechanism works in basically the same way. The two drive mechanisms operate independently of one another allowing the rider to impart power through either or both pedal(s) at any time.

Suspension and Steering

The retaining components of trucks 70 and 70R each form a wishbone type suspension. Suspension springs 72 and 72R serve to absorb shocks created by variation and debris in the riding surface. These shocks would otherwise be transmitted to the feet of the rider.

Front truck (FIG. 9), for example, may move up or down slightly, pivotal action occurring at pins 64, 67, and 73 while bending occurs in suspension spring 72. When either or both front wheels hit a bump the central portion of truck 70 rises, working against the resistance in suspension spring 72. Conversely, when a crevice is reached (or the other side of a bump), the central portion of truck 70 descends, and the tension in suspension spring 72 works to even out the effect of the surface variation and support the feet of the rider.

As with a conventional skateboard, steering is accomplished when the rider rocks the vehicle's riding surface to the left or right. The pivotal steering axes of front and rear trucks 70 and 70R extend downward and inward toward a point below the center of the vehicle. These steering axes pass through kingpins 71 and 75 in the front and 71R and 75R in the rear. During a turn, the diagonal orientation of the steering axes effectively translates the rocking motion of the vehicle into the counter-rotational pivotal motion (viewed from above) of front and rear trucks 70 and 70R. When the vehicle tilts to the left, for example, the trucks pivot so that the rotational axes of each wheel axle 82 and 82R converge at a point to the left of the vehicle. This point then becomes the center of the turn.

As partially explained earlier, suspension springs 72 and 72R also acts as steering dampeners, biasing the trucks pivotal motion toward the center of their steering range. Their pivotal connections through tangs 74 and 74R at lower kingpins 75 and 75R respectively, are out of alignment with the the steering axes. This creates a situation where suspension springs 72 and 72R must twist when either truck 70 or 70R pivots along its steering axis. Their resistance to this twisting biases trucks 70 and 70R to keep the vehicle traveling straight and must be overcome by the rider's feet when tilting the riding surface as during a turn.

As mentioned earlier, each steering axis should as much as possible be in line with the section of drive belt 52 which stretches between its respective drive roller and drive sleeve (66 to 76 in the front and 66R to 76R in the rear, FIG. 5). The truck's pivotal motion about the steering axis then merely causes drive belt 52 to twist slightly along this section when the vehicle is turned. Any other arrangement would cause disruptive strain and wear along the edges of drive belt 52 as it would no longer approach axle 82 or 82R at a right angle. This problem would occur when turning and pedaling simultaneously, at which time significant driving tension would be instilled in drive belt 52 and trucks 70 or 70R would be pivoted away from the center of their steering range. Steering ability might also be affected by the unequal tension on axle 82 or 82R across the width of its engagement with drive belt 52.

Also alluded earlier, the angles of lower kingpins 75 and 75R do not have to be vertical in order to achieve steering biasing, they merely have to be out of alignment with the steering axes. When finalizing the design one may have to adjust these angles along with the dimensions and materials of suspension springs 72 and 72R in order to achieve appropriate relative biasing in the suspension and steering systems.

THIRD EMBODIMENT—FIGS. 11 and 12

The third embodiment is presented as a modification to the second embodiment. It encompasses a function actuating means which provides a means whereby other useful mechanisms, for example brakes, may be actuated. It is designed so the actuation can occur while the vehicle is being ridden with a minimal loss of riding stability.

STRUCTURE OF THIRD EMBODIMENT

The rear pedal brackets 54R and 55R of the second embodiment (FIGS. 5 and 6) are replaced by a single new rear pedal bracket 100 (FIG. 12). Rear pedal bracket 100 has two vertical cross members separating and rigidifying its right and left sides. Front and rear pedal yokes 101 and 103 are pivotally retained by pins 102 and 104 respectively at the middle of these cross members. These mountings are such that the pivotal axes of yokes 101 and 103 are coaxial along a lengthwise axis (when pedal 53R is depressed).

A pair of dampener adjustment screws 109 and 110 are located, one on each side of front yoke 101. They are threaded up through the cross member and each have a shoulder on their upper end which allows them to abut into left and right washers 107 and 108 respectively. Washers 107 and 108 in turn support two rubber dampeners 105 and 106 which may be cemented in place if necessary. Rear pedal 53R is then screwed down firmly to front and rear pedal yokes 101 and 103. The two dampener adjustment screws 109 and 110 are accessible from the bottom and are adjusted to press rubber dampeners 105 and 106 up against the bottom of pedal 53R. Pedal 53R is then allowed to pivot on pins 102 and 104 but is biased to stay flat by the pressure in dampeners 105 and 106.

Actuating lever 112 (FIG. 11) is pivotally retained in its midsection by pin 114 to frame 50. Cable 115 is threaded through a hole in the rear end of actuating lever 112 where it is restrained by a ball end. Cable 115 then passes through cable housing stop 116 and into cable housing 117 where it continues on, terminating at whatever mechanism it will activate. Check lever 111 is pivotally retained in its middle by pin 113 to the front end of actuating lever 112. Check lever 111 has two uprights, one on each end, which terminate directly below the left sides of front and rear pedals 53 and 53R respectively.

OPERATION OF THIRD EMBODIMENT

Let us assume the slave mechanism of cable 115 is a brake, and the rider's left foot is on the front pedal and right foot is on the rear pedal. The rider's toes would then be toward the right side and heels would be toward the left side of each pedal. To stop, the rider continues steering the vehicle with front pedal 53 and tilts rear pedal 53R to the left by pressing with the right heel and letting the right toes rise. The rear pedal then pivots independently of the rest of the vehicle on pins 102 and 104.

The left side of rear pedals 53R presses down on the rear upright of check lever 111 causing it to pivot at pin 113. This pushes the front upright of check lever 111 up against the bottom of the left side of front pedal 53. The front upright of check lever 111 can then no longer move upward so it acts as a fulcrum forcing pin 113 downward and pulling the front end of actuating lever 112 downward also. Actuating lever 112 pivots on pin 114 causing its rear end to rise and pull the end of cable 115 upward. Cable 115 actuates the braking mechanism, allowing the rider to brake without having to reposition his or her feet on the pedals.

The braking mechanism would then provide the necessary spring tension to return the actuating mechanism to its original position, transmitting it back through cable 115. It is important to note that check lever 111 must push up against the bottom of both pedals to deliver significant force to actuating lever 112. If either pedal is not fully depressed, check lever 111 will not have the double fulcrum that is necessary to overcome the spring tension in actuating lever 112 provided by the braking mechanism. This is a safety feature as the slave mechanism could only be activated in the more stable riding state of both pedals down.

Dampeners 105 and 106 should be selected and adjusted to supply significant resistance to the independent tilting of pedal 53R. This resistance should be well in excess of that provided by the steering dampening. This will decrease the likelihood of accidentally actuating the slave mechanism, and allow the vehicle to be steered by the rear foot only if necessary. This is especially important when the front foot is engaged in a pedal stroke because at that time the rear foot provides most of the impetus for steering.

For the sake of description, I have shown the actuating mechanism as located outside frame 50 and operating a cable. There are various other arrangements where it may be located inside frame 50 and/or have a linkage which affects a slave mechanism more directly or by some other means, for example by levers, a chain, or hydraulically.

A similar actuating mechanism could of course be located on the right side of the vehicle. It would be engaged by the independent tilting of rear pedal 53R to the right. A total of two slave mechanisms would be provided for with this arrangement.

FOURTH EMBODIMENT—FIG. 13

STRUCTURE OF FOURTH EMBODIMENT

The fourth embodiment (FIG. 13) is similar to the second embodiment (FIGS. 4–10). It differs primarily in that pedal brackets 204, 205, and 206 are shaped differently than pedal brackets 54, 55, 54R, and 55R of the second embodiment and are positioned to the outside of frame 200 rather than to the inside of frame 50 as is the case with the second embodiment. In the fourth embodiment, the lack of obstruction from a center deck 202 extending the full width of the vehicle (51, FIG. 5) allows for shallower angles in the shapes of pedal brackets 204, 205, and 206 while retaining the overlapping pedal pivot feature discussed in the second embodiment. The fourth embodiment is shown without the spring suspension system of the second embodiment, the fourth embodiment having its drive roller 211 pinned directly to frame 200. The drive mechanism of the fourth embodiment is of the partially reciprocating flexible drive element variety described fully in the second embodiment.

OPERATION OF FOURTH EMBODIMENT

The rider is shown just starting to push down on front pedal 201. Normally, when pedal 201 has been fully depressed the rider would either coast or lift their rear foot to prepare for the depression of rear pedal 203. Although the rider could pedal exclusively with either foot due to the independent functioning of the front and rear drive mechanisms, the most efficient method of pedaling would be to shift their body weight back and forth, setting up a gentle rocking motion as they successively operate front and rear pedals 201 and 203 in an alternating manner.

CONCLUSION AND SCOPE

The various embodiments of the pedal-powered skateboard provide a unique vehicle which will provide many hours of recreational pleasure, as well as a convenient and alternative form of transportation for a wide range of age groups. Its drive system is more efficient than that of a conventional skateboard as it allows the rider to keep their weight generally over the vehicle and in line with the direction of travel. Its design, operability, and potential for speed are clearly superior to prior art devices, providing, among other things, some or all of the following: a more appropriate drive ratio, a workable steering system, a shock absorbing suspension system, a lower pedals-depressed profile, larger pedals, a longer pedal stroke, a less steep returned pedal angle, and a safety oriented actuating mechanism which may be used for brakes or the like. Thus the invention provides a novel and useful means of non-motorized motion, one which will not only provide a form of conveyance and entertainment, but one which will present interesting challenges to human skill and dexterity as well as an opportunity to increase physical strength and endurance.

While the above description contains many specificities, these should not be construed as limitations on the scope of the invention, but rather as exemplification of several of its possible forms. Following then, are further examples of possible variations on this invention.

An only one pedal version of the vehicle could be made. The vehicle could be equipped with brakes, perhaps of the drum or disk variety, a drive-ratio-changing means and/or a pedal hold down means as previously mentioned. The pedal hold down means would allow the rider to store, ride or perform stunts with the vehicle in its more compact state of the pedals being depressed. These mechanisms might be operated by the actuating mechanism of the third embodiment or by an independent pedal or lever located on one of the pedals or elsewhere on the vehicle. Another type of actuating mechanism, similar to the one of the third embodiment, could be designed that allowed both pedals to be equipped. In this case the pedal-tilting mechanism of the third embodiment might be built to operate more like a double acting hinge, such as is found on a swinging door. This would provide a stable "resting" section in the middle of its tilting range and allow the use of two actuating mechanisms for each pedal.

Cranks 16 and 17 (FIGS. 2 and 3) of the first embodiment could swing all the way around instead of reciprocating in the same arc. In this case the return spring mechanism would differ and would probably consist of springs directly affecting the pedals or pedal brackets. The cranks may then be designed to act as flywheels. These would develop the momentum necessary to ease the crankpins past the points in the crank's motion where the push rods are normal to the crank circle and little effect is had by either the weight of the rider's feet or the return springs. A cam lobe on the flywheel may also be used in conjunction with a sprung roller to help accomplish this.

The first embodiment could be designed with the overlapping pedal pivot feature shown in the second and fourth embodiments. The front and rear pedal brackets of any embodiment with the overlapping pedal pivot feature could be designed to operate exclusively to the right and left of each other. An extrusion, such as a wide channel or rectangular tube could be used as a single pedal bracket for each pedal instead of separate right and left pedal brackets. In this case the front pedal bracket would be positioned to operate to the right of center and the rear pedal bracket would operate to the left of center (or vice-versa). This could eliminate the need for the shape of the pedal brackets to have a lowered section in the middle to clear other components. It could also eliminate the need for a center deck if the two deck halves (pedal surfaces) were split by an "S" shaped curve.

The pedals could be retained and move up and down differently. For example they could be supported by a roller-track-and-scissors type of mechanism. This would allow the pedal surfaces to stay more parallel to the riding surface throughout their stroking motion. It would also allow the inside edges of the pedals to rise perpendicularly to the ground, permitting these inside edges to be positioned adjacently, again without need of a center deck. Another way to achieve this would be to have a telescoping track and roller assembly supporting the pedals. This could be curved if it were desired that the pedals rise at a slight angle.

The point of securement of drive belt 52 to upper frame plate 50A (FIGS. 5 and 6) in the second embodiment could be adjustable to vary the drive ratio. Another possible drive-ratio-changing mechanism would transfer this same point of securement to the moving pedal bracket, effectively deactivating pedal roller 53 and/or 53R. This mechanism would cut the drive ratio approximately in half by eliminating the velocity increase of drive belt 52 at, for example, drive sleeve 76 provided by pedal roller 58. A different number and arrangement of rollers could be used. Front and rear drive mechanisms could be built or adjusted, each with their own drive ratio. This would allow one pedal to be used primarily for speed and the other primarily for power. A hydraulic or pneumatic power transmission could be used. Substituting flexible tubing for more strictly mechanical linkages would eliminate some of the difficulties of integrating the steering system with the propulsion system.

Different types and shapes of materials could of course be used. In the second embodiment for example, plywood, plastic, fiberglass or a stiff rubber-sprung plate could be used instead of suspension springs 72 and 72R; a drive cable could be substituted for the drive belt, and the pedals could be any of a number of differing combinations of shapes and materials.

A skilled artisan could no doubt think of many other variations. Accordingly, the scope of the invention should be determined not by the embodiments illustrated, but by the appended claims and their legal equivalents.

I claim:

1. A human-powered vehicle, comprising:

a plurality of wheels for enabling said vehicle to roll when placed on a surface, a rider-supporting platform having a discontinuous surface so as to provide a plurality of sections, one of said sections comprising a front pedal, and one of said sections comprising a rear pedal, pedal-support means attached to each said pedal for mounting said pedals, pivoting means attached to each said pedal-support means for enabling said pedals to reciprocate in generally vertical directions, said pivoting means for said front pedal being located generally to the rear of said pivoting means for said rear pedal so as to make each of said pedals have as long a lever arm as possible, thereby reducing the angular deviation required of each of said pedals for any given length of pedal stroke, power-transmission means for causing at least one of said wheels to rotate in response to the depression of one of said pedals, pedal-return means for biasing said pedals to return to the top of their strokes, and retaining means for holding all of the foregoing components of said vehicle in their aforecited functional relationships.

2. The vehicle of claim 1 wherein said power transmission means is arranged so that said pedals can function independently of each other, whereby said vehicle may be coasted with said pedals in any position or propelled with either or both of said pedals at any time.

3. The vehicle of claim 1 wherein said power transmission means is arranged so that said front pedal includes means for driving at least one front wheel, and said rear pedal includes means for driving at least one rear wheel, whereby the driven wheels are less likely to lose traction with the ground as one is always generally under the weight of the foot that is imparting its own power.

4. The vehicle of claim 1 wherein at least one said pedal-support means includes a lever-type support member generally shaped with a lowered section in the middle for permitting it to clear other components of said vehicle throughout its range of pedaling motion.

5. The vehicle is claim 1 wherein said power-transmission means includes:

a connecting rod with means for transmitting power from one of said pedals to a cranking member, a single-direction-rotational-engaging mechanism for transmitting power from said cranking member to a rotational-driving member, and means for enabling said rotational-driving member to drive at least one of said wheels.

6. The vehicle of claim 1 wherein said power-transmission means includes:

a flexible drive element, means for causing said drive element to be at least partially put in motion by the generally downward motion of one of said pedals, means for said drive element to alternately wind upon and unwind from a wheel-driving member, and means for enabling said drive element to drive said wheel-driving member as it unwinds therefrom.

7. The vehicle of claim 5 further including crank motion-limiting means for limiting the rotational motion of said cranking member such that said cranking member cannot make a complete revolution about its crank axis, but rather must pivot back and forth in a limited arc.

8. The vehicle of claim 1 further including:

a flat-belt drive element, means for causing said flat-belt drive element to be at least partially put in motion by the generally downward motion of one of said pedals, a wheel driving member for driving at least one of said wheels, means for causing said flat-belt drive element to alternately wind upon and unwind from said wheel-driving member, means for said drive element to drive said wheel-driving member as it unwinds therefrom, steering means including a wheel-retaining truck for rotatably retaining two of said wheels, retaining means for said wheel-retaining truck for providing a pivotal steering axis for said truck such that steering may be accomplished by the side-to-side tilting of said rider-supporting platform, a rotational-guiding member for guiding said drive element where it approaches said wheel-driving member, and a section of said drive element extending from said rotational-guiding member to said wheel-driving member being in at least close alignment with said steering axis, whereby said drive element has means to cooperate with said steering means by merely twisting at said section when said vehicle is turned to the left or right as in steering.

9. The vehicle of claim 1 wherein said power-transmission means includes:

a flexible drive element, means for causing said flexible drive element to be at least partially put in motion by the generally downward motion of one of said pedals, a wheel driving member for driving at least one of said wheels, means for causing said flexible drive element to alternately wind upon and unwind from said wheel-driving member, means for causing said flexible drive element to drive said wheel-driving member as it unwinds therefrom, means for pushing a pedal-driven rotational member into a section of said flexible drive element so that said pedal-driven rotational member contributes velocity to said section of said flexible drive element which in turn drives said wheel-driving member.

10. The vehicle of claim 1, further including:

a flat spring member, suspension means for causing said flat spring member to springably suspend said vehicle, whereby shocks encountered in the riding surface will be at least partially absorbed, a wheel retaining truck attached to said vehicle by at least two pivotal connections so as to provide a pivotal steering axis extending between said pivotal connections, said steering axis being oriented such that steering may be accomplished by the side-to-side tilting of said supporting platform, at least one of said pivotal connections having a pivotal axis which is significantly out of alignment with said steering axis, said pivotal connection being attached to said flat spring member such that said flat spring member is caused to distort by twisting when said vehicle is turned, thereby biasing said vehicle to travel in a generally straight line.

11. The vehicle of claim 1, further including an actuating means for the purpose of operating a useful slave mechanism such as brakes, said actuating means comprising:

pivoting means for enabling one of said sections of said rider-supporting platform to be tilted to at least one side independently from another of said sections of said rider-supporting platform, and an actuating mechanism for enabling first said section to operate said slave mechanism as it is tilted to said side, whereby the feet of a rider with one foot on the first said section and other foot on the second said section may actuate said slave mechanism by a sideward tilting of the first of said sections relative to said second section.

12. A human-powered vehicle comprising:

a plurality of wheels for enabling said vehicle to roll when placed on a surface, a rider-supporting platform having a discontinuous surface so as to provide a plurality of sections, one of said sections comprising a pedal, support means for enabling said pedal to reciprocate in generally vertical directions, pedal-return means for biasing said pedal to return to the top of its stroke, power-transmission means including a flat-belt drive element, means for causing said flat-belt drive element to be at least partially put in motion by the generally downward motion of said pedal, a wheel driving member for driving at least one of said wheels, means for causing said flat-belt drive element to alternately wind upon and unwind from said wheel-driving member, means for said flat-belt drive element to drive said wheel-driving member as it unwinds therefrom, steering means including a wheel-retaining truck for rotatably retaining two of said wheels, retaining means for said wheel-retaining truck for providing a pivotal steering axis for said truck such that steering may be accomplished by the side-to-side tilting of said rider-supporting platform, a rotational-guiding member for guiding said flat-belt drive element where it approaches said wheel-driving member, a section of said flat-belt drive element extending from said rotational-guiding member to said wheel-driving member being in at least close alignment with said steering axis, whereby said flat-belt drive element is caused to cooperate with said steering means by merely twisting at said section when said vehicle is turned to the left or right as in steering, and retaining means for holding all of the foregoing components of said vehicle in their aforecited functional relationships.

13. A human-powered vehicle comprising:

a plurality of wheels for enabling said vehicle to roll when placed on a surface, a rider-supporting platform having a discontinuous surface so as to provide a plurality of sections, one of said sections comprising a pedal, support means for enabling said pedal to reciprocate in generally vertical directions, pedal-return means for biasing said pedal to return to the top of its stroke, power-transmission means utilizing a flexible drive element with means for causing said flexible drive element to be at least partially put in motion by the generally downward motion of said pedal, a wheel driving member for driving at least one of said wheels, means for causing said flexible drive element to alternately wind upon and unwind from said wheel-driving member, means for causing said flexible drive element to drive said wheel-driving member as it unwinds therefrom, means for pushing a pedal-driven rotational member into a section of said flexible drive element so that said pedal-driven rotational member contributes velocity to said section of said flexible drive element which in turn drives said wheel-driving member, and retaining means for holding all of the foregoing components of said vehicle in their aforecited functional relationships.

14. A vehicle comprising:

a rider-supporting platform, a plurality of wheels for enabling said vehicle to roll when placed on a surface, a wheel-retaining truck for rotatably retaining at least two of said wheels, upper and lower retaining arms attaching said wheel-retaining truck to said vehicle and generally extending in a fore to aft direction, said retaining arms having appropriate means of attachment to said vehicle at each of their proximal ends, and to said wheel-retaining truck at each of their distal ends, so as to provide a wishbone-type suspension linkage between said wheel-retaining truck and said vehicle, said retaining arms having sufficient lateral rigidity to insure functional alignment of said wheel-retaining truck during the operation of said vehicle while allowing said wheel-retaining truck, and so said wheels, to move up and down in the event that shock producing irregularities are encountered in the riding surface, at least one of said retaining arms being a spring retaining arm and incorporating an integral flat spring member whose proximal end is fixedly attached to said vehicle such that it is caused to bend when said wheel-retaining truck moves up and down, said flat spring member thereby springably suspending said vehicle in the event that shock producing irregularities are encountered in the riding surface, upper and lower steering pivots each attaching said wheel-retaining truck to the distal ends of corresponding said upper and lower retaining arms, a steering axis about which said wheel-retaining truck is caused to pivot in the event of steering, said steering axis being generally defined by a line passing through the active centers of said upper and lower steering pivots and being specifically inclined such that steering may be accomplished by the side-to-side tilting of said rider-supporting platform, a torsion-resisting pivot being that said steering pivot which attaches said spring retaining arm to said wheel-retaining truck, the pivotal axis of said torsion-resisting pivot being in a specifically non-coaxial though intersecting relationship with said steering axis, said pivotal axis of said torsion-resisting pivot being oriented at an appropriate angle to said steering axis so as to impart torsional forces in said flat spring member when said rider-supporting platform is tilted as in the event of steering, the resistance of said flat spring member to said torsional forces thereby biasing said vehicle to travel in a generally straight line, retaining means for holding all of the foregoing components of said vehicle in their aforecited functional relationships.

* * * * *